US006637310B2

(12) United States Patent
Borgwarth

(10) Patent No.: US 6,637,310 B2
(45) Date of Patent: Oct. 28, 2003

(54) ROTATABLE BREECH GUN

(75) Inventor: Dennis Borgwarth, Anoka, MN (US)

(73) Assignee: United Defense L.P., Arlington, VA (US)

( * ) Notice: Subject to any disclaimer, the term of this patent is extended or adjusted under 35 U.S.C. 154(b) by 48 days.

(21) Appl. No.: 09/797,294

(22) Filed: Mar. 1, 2001

(65) Prior Publication Data

US 2003/0159574 A1 Aug. 28, 2003

(51) Int. Cl.[7] ..... F41A 9/16
(52) U.S. Cl. ..... 89/33.03; 89/25
(58) Field of Search ..... 89/33.03, 155, 89/156, 157, 45, 46, 25

(56) References Cited

U.S. PATENT DOCUMENTS

| | | | | |
|---|---|---|---|---|
| 38,772 A | | 6/1863 | Underwood | |
| 39,232 A | | 7/1863 | Howard | |
| 913,756 A | | 3/1909 | McCarty | |
| 2,790,353 A | * | 4/1957 | Bird | 89/1.7 |
| 2,845,007 A | * | 7/1958 | O'Brien | 89/155 |
| 2,866,386 A | | 12/1958 | Lucht | |
| 4,004,363 A | | 1/1977 | Sackenreuter et al. | 42/9 |
| 4,091,711 A | | 5/1978 | Petersen et al. | 89/7 |
| 4,348,941 A | * | 9/1982 | Ketterer et al. | 89/155 |
| 4,599,933 A | | 7/1986 | Stoner | 89/33.03 |
| 4,825,743 A | | 5/1989 | Balsavage et al. | 42/9 |
| 4,993,312 A | | 2/1991 | Achterholt | 89/155 |
| 5,335,581 A | * | 8/1994 | Simon et al. | 89/33.03 |
| 5,353,678 A | | 10/1994 | Rochelle et al. | 89/9 |
| 5,610,362 A | | 3/1997 | Bouvard | 89/33.1 |
| 6,044,748 A | | 4/2000 | Westrom | 89/185 |

FOREIGN PATENT DOCUMENTS

| | | | | |
|---|---|---|---|---|
| EP | 36 811 | * | 9/1981 | 89/33.03 |

* cited by examiner

*Primary Examiner*—Stephen M. Johnson
(74) *Attorney, Agent, or Firm*—Patterson, Thuente, Skaar & Christensen, P.A.

(57) ABSTRACT

A rotatable breech gun including a breech assembly, a breech housing, and a gun barrel. The breech assembly has a breech bore formed therein that receives ammunition loaded through an end thereof. The breech housing has at least one side member oriented parallel to the breech bore. The breech assembly is rotatably mounted in the breech housing. The gun barrel has a gun bore extending therethrough. The gun barrel is operably connected to the breech housing such that the gun bore is aligned with the breech bore when the breech assembly is rotated in position within the breech housing. The breech assembly and the breech housing further include corresponding mating structures proximate at least one end of the breech bore such that forces generated by ignition of ammunition in the breech bore are transmitted to both the breech assembly and the at least one side member of the breech housing.

16 Claims, 9 Drawing Sheets

ROTATABLE BREECH GUN

FIELD OF THE INVENTION

The present invention relates generally to an easily loadable gun. More particularly, the present invention relates to a rotatable breech gun.

BACKGROUND OF THE INVENTION

Telescoped ammunition enhances shell storage densities and ammunition feeding because telescoped shells are more uniform in diameter and shorter in length than conventional shells of comparable caliber. Although telescoped shells are generally larger in diameter than equivalent conventional shells, their generally shorter length facilitates shell handling and feeding.

Further advantages of telescoped ammunition include enhanced cannon design and configuration because of the shorter ammunition length. For example, the breech loading mechanism may be shorter than the corresponding structure used with conventional shells. This shorter loading mechanism provides more flexibility when designing guns because the gun may be pivoted to a higher degree when used while maintaining a low profile during transportation to the location where the gun is to be used.

One such gun that uses telescoped ammunition is disclosed in Stoner, U.S. Pat. No. 4,599,933. The Stoner gun includes a rotatably mounted breech assembly that is rotated within a breach box to a position that is normal to a central axis of the gun to load ammunition into the gun. Thereafter, the breech assembly is rotated so that the ammunition is aligned along the central axis of the gun so that the gun may be fired. The two side members of the breach box hold the components of the gun together when the ammunition is fired.

Still other patents disclose the use of using rotatable chambers to load ammunition into guns. For example, Underwood, U.S. Pat. No. 38,772; Howard, U.S. Pat. No. 39,232; Achterholt, U.S. Pat. No. 4,993,312; and Bouvard, U.S. Pat. No. 5,610,362, each disclose handheld guns having a loading mechanism that is rotatable along an axis that is normal to a central axis of the gun.

Bird, U.S. Pat. No. 2,790,353, discloses a mechanism for feeding ammunition into a firearm. The mechanism includes a chamber that is rotatable about an axis that is parallel to and offset from a central axis of the gun. When the chamber is in the loading position, a projectile is fed into a front portion of the chamber and the propellant is fed into a back portion of the chamber. Thereafter, the drum is rotated to move the loaded chamber into alignment with the gun barrel and the gun is fired.

In spite of the many benefits associated with the use of telescoped ammunition in rotatable breech guns, the forces generated in large bore variations of these guns causes the components in the rotatable breech region of the gun to separate and thereby permit gas to leak from the gun during the firing process. The leaking gases not only adversely affect the performance of the gun but also require the use of additional precautions to prevent operators who fire the gun from being injured by contact with the gases.

While it is theoretically possible to increase the strengths of the components in rotatable breech guns by simply making the components of the breech box from thicker materials, using thicker materials increases the overall weight of the rotatable breech guns, which reduces the ability to easily transport these guns to the location where the guns are to be used.

Rochelle et al., U.S. Pat. No. 5,353,678 propose one solution to address some of the issues associated with using telescoped ammunition. Rochelle et al disclose forming the gun without a breech box. The breech, the chamber and the sleeve are retained using collars at the front and rear ends of the chamber. The collars engage grooves in the breech and the sleeve to maintain the components together during firing without the need for a breech box.

SUMMARY OF THE INVENTION

The present invention is directed to a rotatable breech gun. The rotatable breech gun includes a breech assembly, a breech housing and a gun barrel. The breech assembly has a breech bore formed therein that receives ammunition loaded through an end thereof. The breech housing has at least one side member oriented parallel to the breech bore. The breech assembly is rotatably mounted in the breech housing. The gun barrel has a gun bore extending therethrough. The gun barrel is operably connected to the breech housing such that the gun bore is aligned with the breech bore when the breech assembly is rotated in position within the breech housing.

The breech assembly and the breech housing further include corresponding mating structures proximate at least one end of the breech bore such that forces generated by ignition of ammunition in the breech bore are transmitted to both the breech assembly and the at least one side member of the breech housing.

Transmitting forces generated by ignition of ammunition to both the breech assembly and the at least one side member of the breech housing produces a seal between the breech assembly and the breech housing that prevents or substantially reduces the flow of gases generated during firing of the rotatable breech gun from passing between the breech assembly and the breech housing.

DETAILED DESCRIPTION OF PREFERRED EMBODIMENTS

Figure 1:
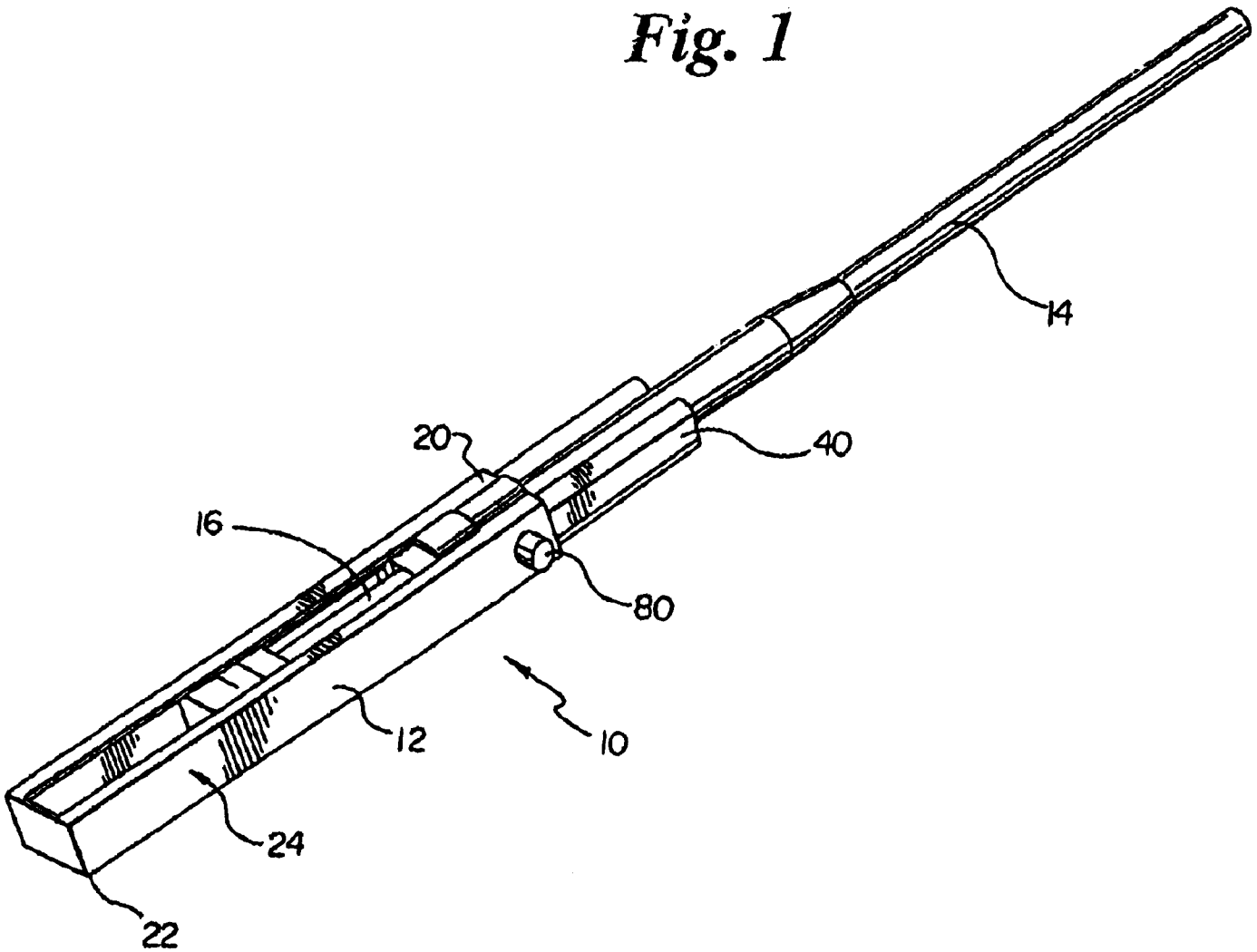
FIG. 1 is a perspective view of a rotatable breech gun in a firing disposition according to the present invention.

The present invention is directed to a rotatable breech gun, as most clearly illustrated at 10 in FIG. 1. The rotatable breech gun 10 generally includes a gun slide 12, a gun barrel 14, a rotatable breech assembly 16, and a breech housing 18.

Figure 2:
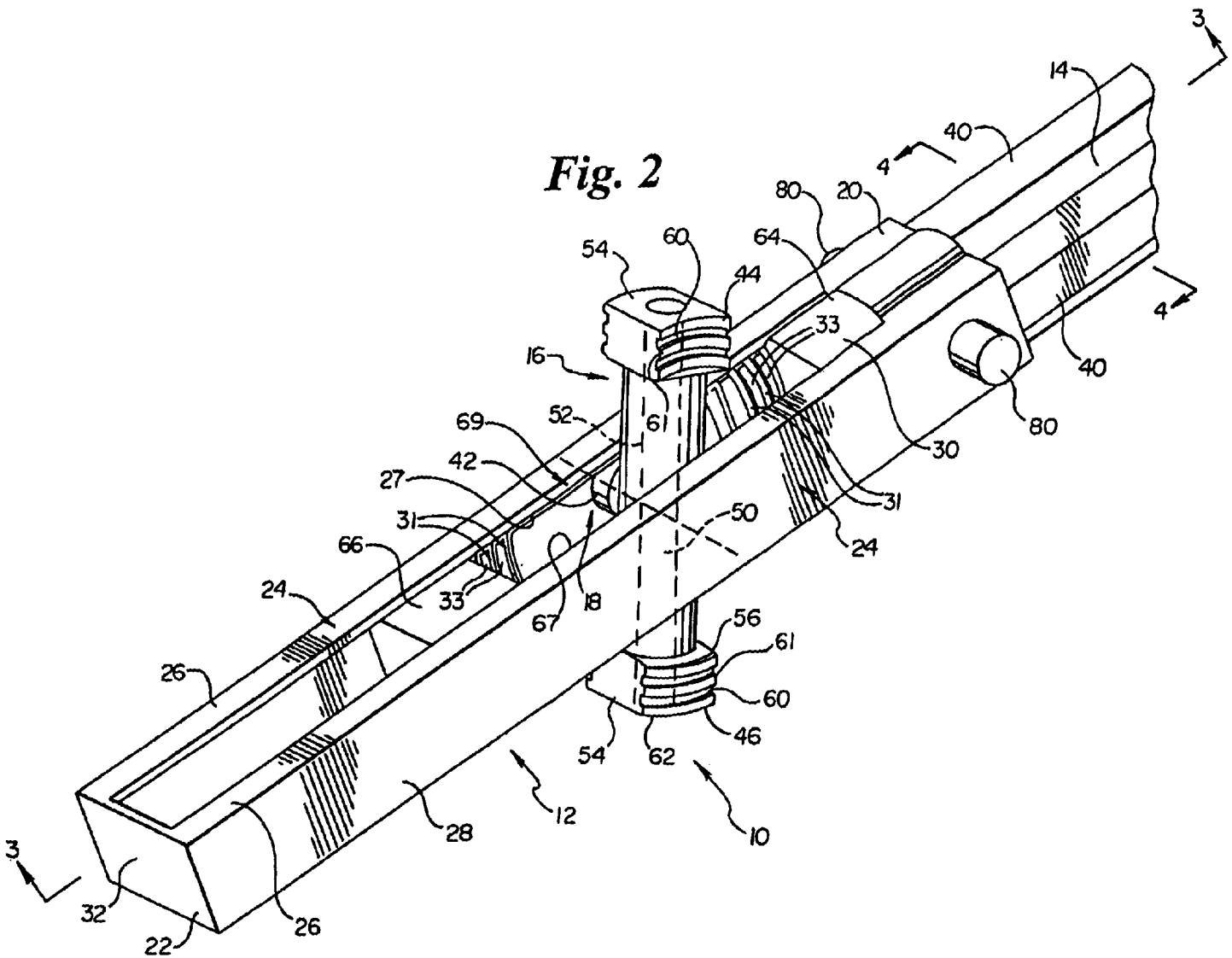
FIG. 2 is a perspective view of the rotatable breech gun with the breech assembly in a rotated reload position.
Figure 3:
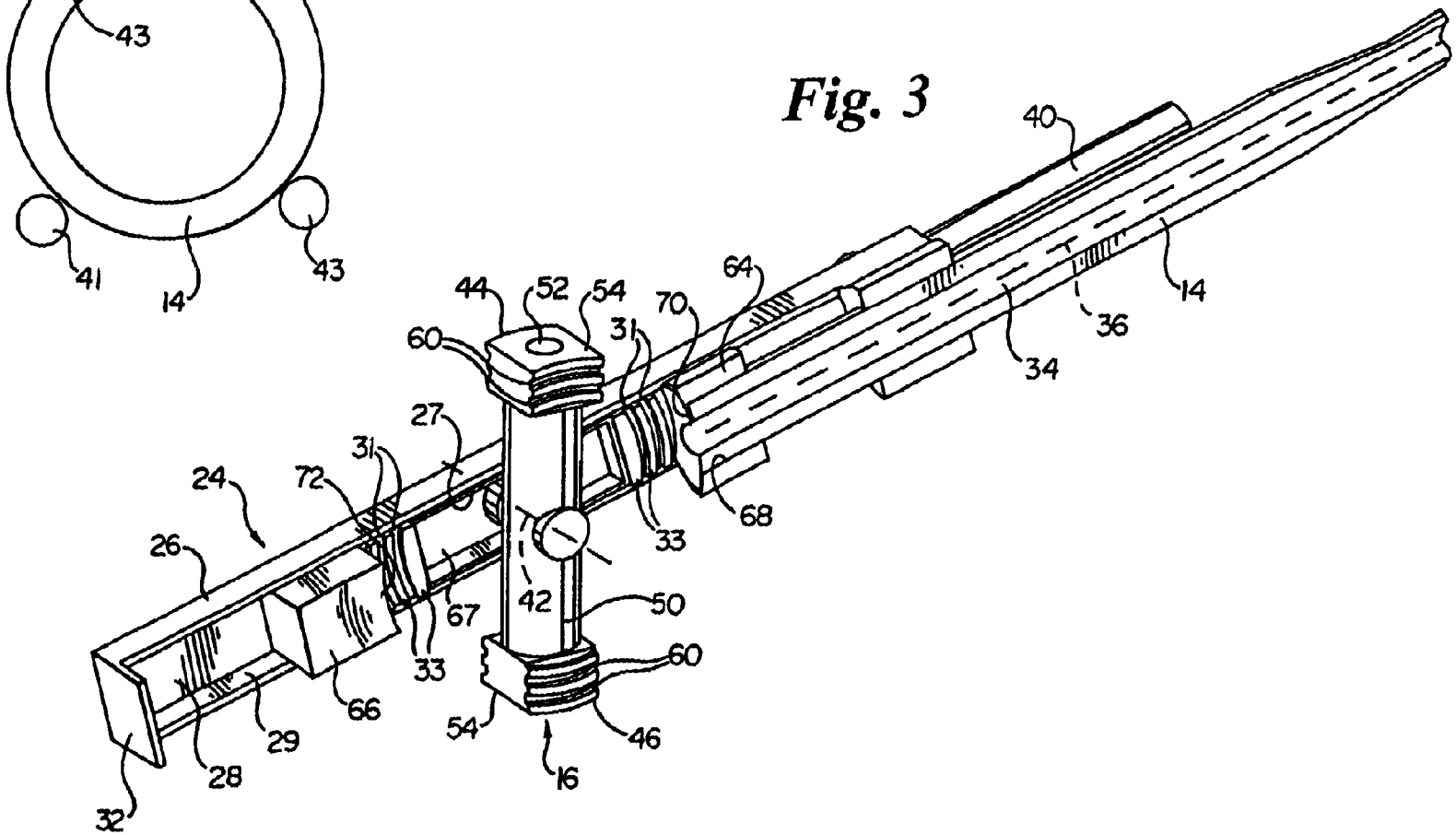
FIG. 3 is a perspective view of the rotatable breech gun with the breech housing and gun barrel depicted in section along a line 3—3 in FIG. 2.

The gun slide 12 has a generally elongated configuration with a front end 20 and a back end 22, as most clearly illustrated in FIGS. 2 and 3. The gun slide 12 includes a pair of side members 24 that extend from the front end 20 to the back end 22. A person of ordinary skill in the art will appreciate that the concepts of the present invention are also adaptable for use with a gun slide that only includes a single side member 24.

Each of the side members 24 includes a top wall 26, a side wall 28, and a bottom wall 29. The side members 24 are interconnected with a front plate 30 and a rear plate 32. The side members 24, the front plate 30 and the rear plate 32 define a partially enclosed region 27 that is adapted to receive the breech housing 18. Operable connection of the breech housing 18 to the gun slide 12 is described in more detail herein.

The breech housing 18 has a front block 64, a rear block 66 and a pair of side walls 67 that extend between the front block 64 and the rear block 66. The front block 64, the rear block 66 and the pair of side walls 67 define a partially enclosed region 69 in which the rotatable breech assembly 16 is rotatably mounted.

The side walls 67 each include at least a first set of grooves 31 formed therein proximate a front end and a second set of grooves 31 formed proximate a rear end of the partially enclosed region 69. Intermediate each of the grooves 31 in the first and second sets of grooves 31 is a land 33.

As will be described in more detail below, the breech assembly 16 also includes a first set of grooves 60 and a second set of grooves 60 formed therein. Intermediate each of the grooves 60 in the first and second sets of grooves is a land 61. The grooves 31 and lands 33 in the breech housing 18 are shaped substantially complementary to the grooves 60 and lands 61 in the breech assembly 16 so that lands 33 at least partially seat in grooves 60 and lands 61 at least partially seat in grooves 31. For the sake of clarity of the discussion set forth herein, the interlocking of the rotatable breech assembly 16 and the breech housing 18 will be described as lands 61 seating in grooves 31. Collectively, the lands and grooves are referred to as corresponding mating structures.

The grooves 31 are each preferably curved, as described in more detail below. Each set of grooves 31 preferably includes at least two grooves. However, the number of grooves 31 is selected based upon the diameter of the gun 10 and other factors.

The gun slide 12 is fabricated from a high strength material that is capable of withstanding the forces imparted onto the components of the gun slide 12 during firing operations. The particular material used to fabricate the gun slide 12 and the thicknesses of the components in the gun slide 12 are selected based upon the caliber of the rotatable breech gun 10. Examples of suitable materials for fabricating the gun slide 12 include titanium and high strength steel.

The gun barrel 14 is connected to the front end 20 of the breech housing 18. The gun barrel 14 preferably has a caliber of greater than 50 millimeters and more preferably is about 120 millimeters. The gun barrel 14 has a substantially cylindrical shape and includes a bore 34 extending therethrough. The bore 34 is preferably oriented along a central axis 36 of the gun barrel 14.

The thickness of the gun barrel wall and the material from which the gun barrel 14 is manufactured are selected based upon the caliber of the gun barrel 14 and other factors. Suitable materials for manufacturing the gun barrel 14 include titanium and high strength steel.

Figure 4:
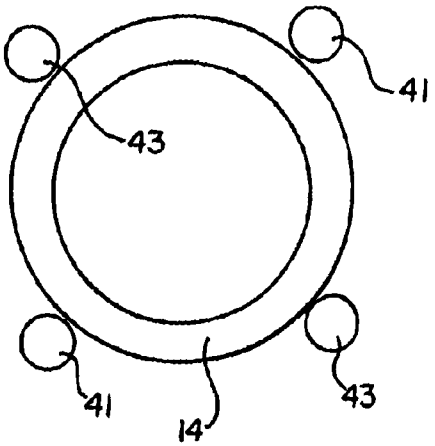
FIG. 4 is a sectional view of the rotatable breech gun taken along a line 4—4 in FIG. 2.

The breech housing 18 is operably attached to the gun slide 12 using a recoil/counter recoil control system 40 to reducing the recoil and counter recoil affects imparted during operation of the rotatable breech gun 10. The recoil/counter recoil control system 40 preferably includes a pair of recoil cylinders 41 and a pair of counter recoil cylinders 43 that are attached in an alternating and approximately evenly spaced relationship around the gun barrel 14, as most clearly illustrated in FIG. 4.

The rotatable breech assembly 16 is mounted for rotation about an axis 42 that is substantially perpendicular to the central axis 36 of the gun barrel 14. Rotating the breech assembly 16 with respect to the breech housing 18 facilitates loading ammunition into the gun 10. The rotatable breech assembly 16 is preferably fabricated in a symmetrical configuration such that a first end 44 of the rotatable breech assembly 16 is shaped substantially the same as a second end 46 of the rotatable breech assembly 16.

The rotatable breech assembly 16 has a substantially cylindrical central portion 50 with a bore 52 extending therethrough. The bore 52 is preferably aligned along the central axis 36 when the rotatable breech assembly 16 is in a firing orientation.

Proximate the first end 44 and the second end 46, the rotatable breech assembly 16 includes end portions 54. Side surfaces 56 of the end portions 54 preferably have at least one groove 60 formed therein. Intermediate each of the grooves 60 are the lands 61. The grooves 60 are preferably curved to correspond with a radius of the rotatable breech assembly 16. Preferably, there are at least two grooves 60 formed on each of the side surfaces 56.

The grooves 31 formed in the breech housing 18 are also preferably curved to correspond with the radius of the rotatable breech assembly 16. This configuration permits the lands 60 to slide through the grooves 31 in a rotational motion. The interaction between the grooves 31 and lands 60 prevents the rotatable breech assembly 16 from moving with respect to the breech housing 18 along the central axis 36.

An end surface 62 of the end portions 54 is also preferably curved to correspond with a radius of the rotatable breech assembly 16. Forming the end portions 54 with curved end surfaces 62 facilitates forming a seal with the other portions of the rotatable breech gun 10 to prevent or substantially reduce gases from passing between the components.

The front block 64 has a bore 68 formed therein. The bore 68 is substantially the same size as and aligned with the bore 52 in the rotatable breech assembly 16. Similarly, the bore 68 is substantially the same size as and aligned with the bore 34 that extends through the gun barrel 14. An inner surface 70 of the front block 64 preferably has a concave shape, as most clearly illustrated in FIG. 3, that substantially conforms to the curvature of the end surfaces 62 of the end portions 54 to facilitate forming a seal between the front block 64 and one of the end portions 54 that prevents or substantially minimizes the amount of gas that passes between these components.

Depending on the configuration of the gun barrel 14, the bore 68 may be formed with a size that is sufficient to permit the gun barrel 14 to extend through the front block 64 to adjacent the rotatable breech assembly 16.

The rear block 66 has an inner surface 72 with a concave shape, as most clearly illustrated in FIG. 3, that substantially conforms to the curvature of the end surfaces 62 of the end portions 54 to facilitate forming a seal between the rear block 66 and the second end portion 54 that prevents or substantially eliminates the amount of gas that passes between these components.

The gun slide 12 is pivotally attached to a gun base (not shown) with a trunnion 80 located on either side of the gun slide 12 proximate the head end 20 of the gun slide 12. The size and material from which the trunnions 80 are fabricated are selected based upon the caliber of the rotatable breech gun 10 and other factors.

The rotatable breech assembly 16 is preferably rotated to a substantially vertical orientation, as illustrated in FIG. 3, for loading the ammunition into the rotatable breech assembly 16. The ammunition preferably includes a propellant and a projectile that may be loaded separately or as a single unit into the rotatable breech assembly 16. Depending on the caliber of the gun and the conditions under which the rotatable breech gun 10 is used, loading of the ammunition into the rotatable breech assembly may be done manually or automatically.

Figure 5:
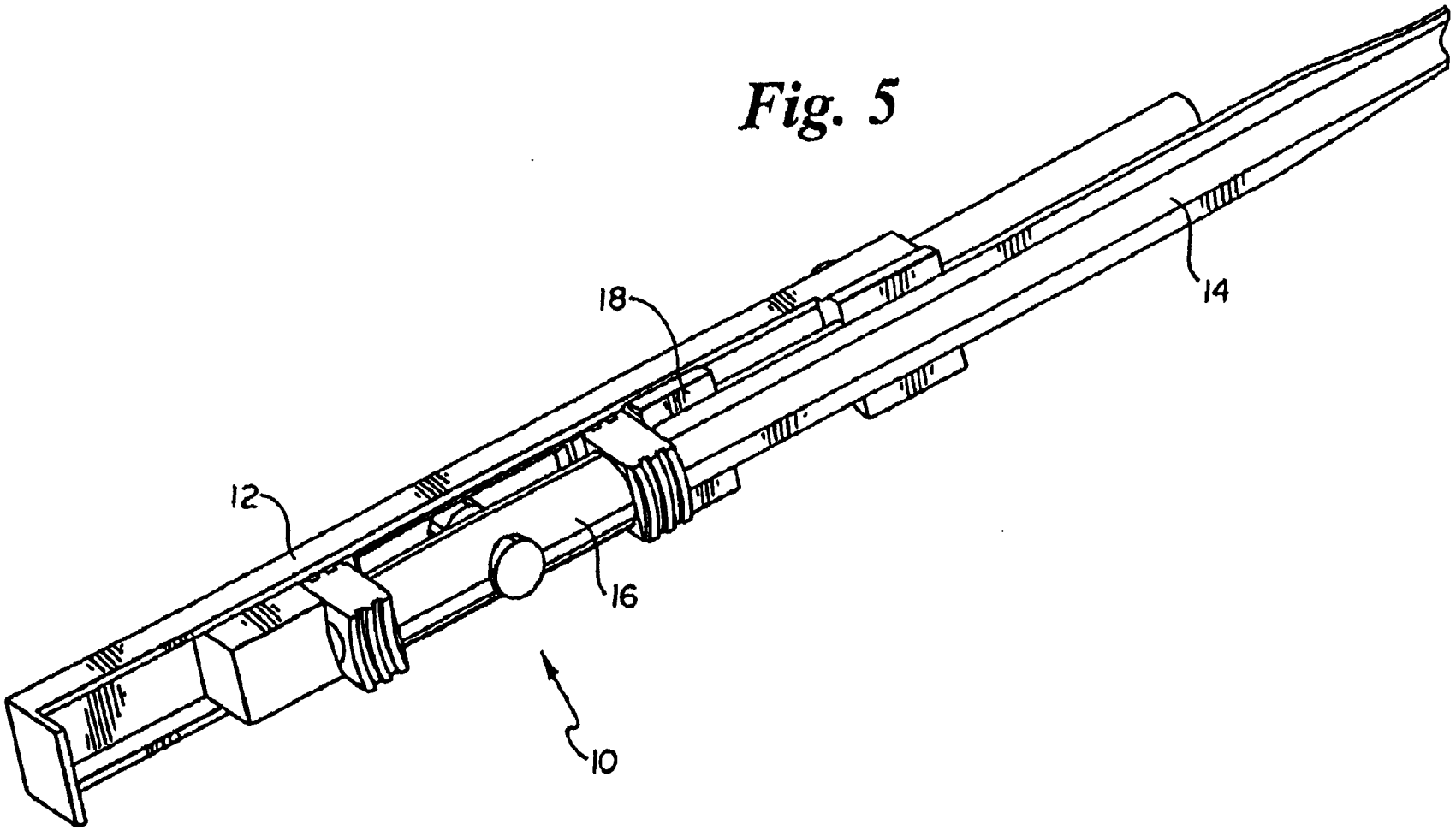
FIG. 5 is a perspective view of the rotatable breech gun with the breech assembly in an initial position.
Figure 6:
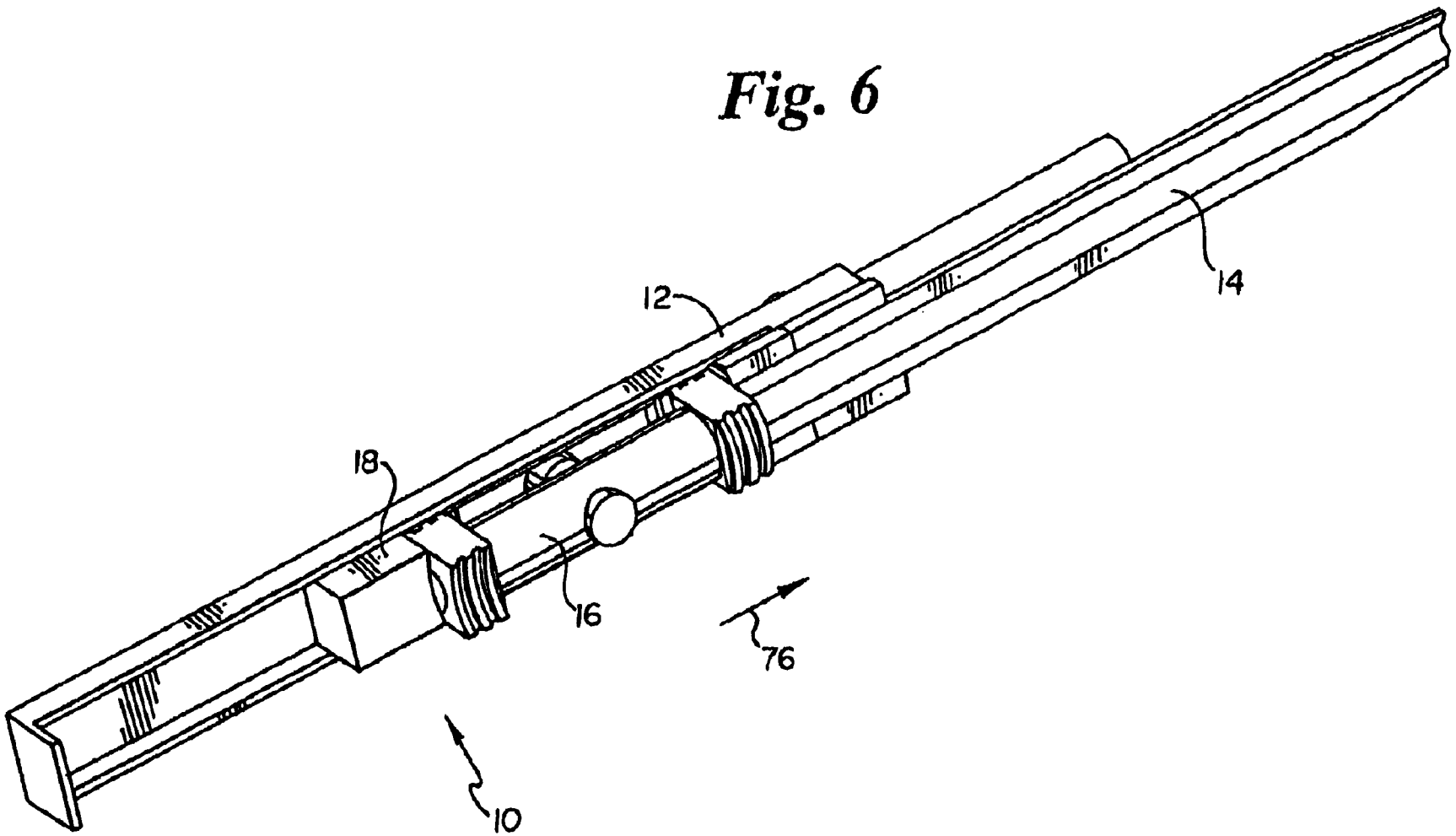
FIG. 6 is a perspective view of the rotatable breech gun with the breech assembly in a firing position.

Next, the breech assembly 16 is rotated so that the breech assembly 16 is aligned along the central axis 36, as illustrated in FIG. 5. To partially compensate for the forces generated during firing, the counter recoil cylinders 43 are activated to move the breech housing 18 forward, as indicated by arrow 76 in FIG. 6. Slightly before the breech housing 18 reaches the head end of the partially enclosed region 27, the rotatable breech gun 10 is fired by igniting the propellant in the breech assembly 16.

Combustion of the propellant causes the ammunition to be propelled through the gun barrel 14 and towards a target. The force needed to propel ammunition is dependent on the size and weight of the ammunition as well as the distance of the target from the gun. For example, the force generated by firing a 120 millimeter gun at 100 ksi is in the range of 1.75 million pounds.

Figure 7:
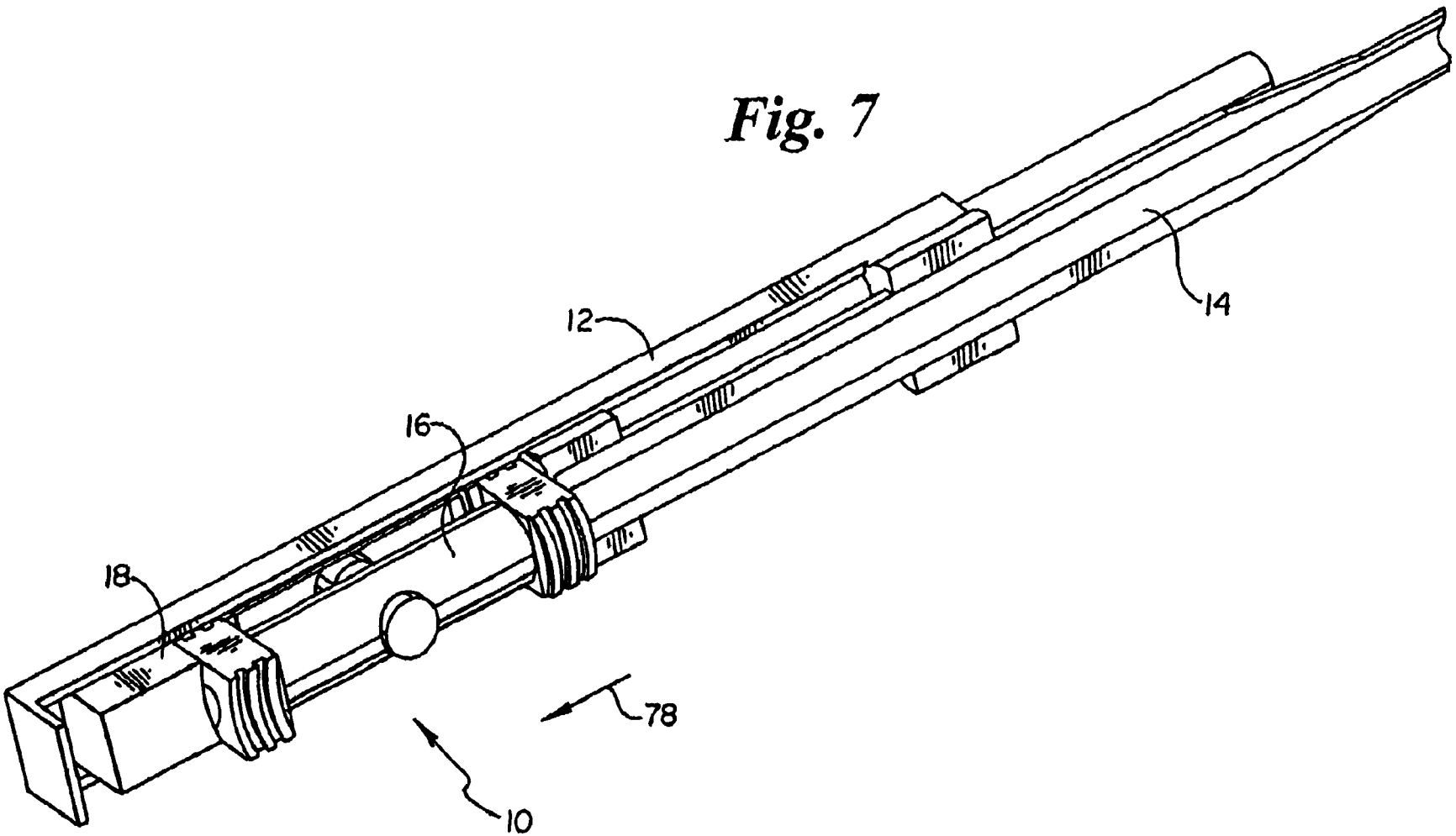
FIG. 7 is a perspective view of the rotatable breech gun with the breech assembly in a full recoil position.

Firing of the gun causes the breech housing 18 to move towards the rear end of the partially enclosed region 27, as indicated by arrow 78 in FIG. 7. The recoil cylinders 41 absorb the force exerted upon the breech housing 18.

A free body diagram of the forces imparted upon the breech assembly of the rotatable breech gun 10 during firing is depicted in FIG. 5. During firing, a force (F) is generated that is approximated by the maximum gun pressure times the gun bore. Accordingly, a 120 millimeter gun firing at 100 ksi, equates to a force on the order of 1.75 million pounds. The magnitude of this force presents significant difficulties in preventing gas from leaking from the breech assembly 16 proximate the intersection of the ends of the breech assembly 16. Ultimately, this force must be transmitted to the trunnion 80 and the recoil system 40. For sake of clarity, the discussion herein applies to the load before reaching the recoil system 40.

The forces generated during the firing of rotatable breech guns cause the components of the rotatable breech gun to stretch. Once the firing forces diminish, the components of the rotatable breech gun substantially return to their original shape. In light of these characteristics, the stretching and contracting of the gun components are characterized as a spring for the purposes of the following discussion of the forces that are produced during firing of the rotatable breech gun.

Figure 8:
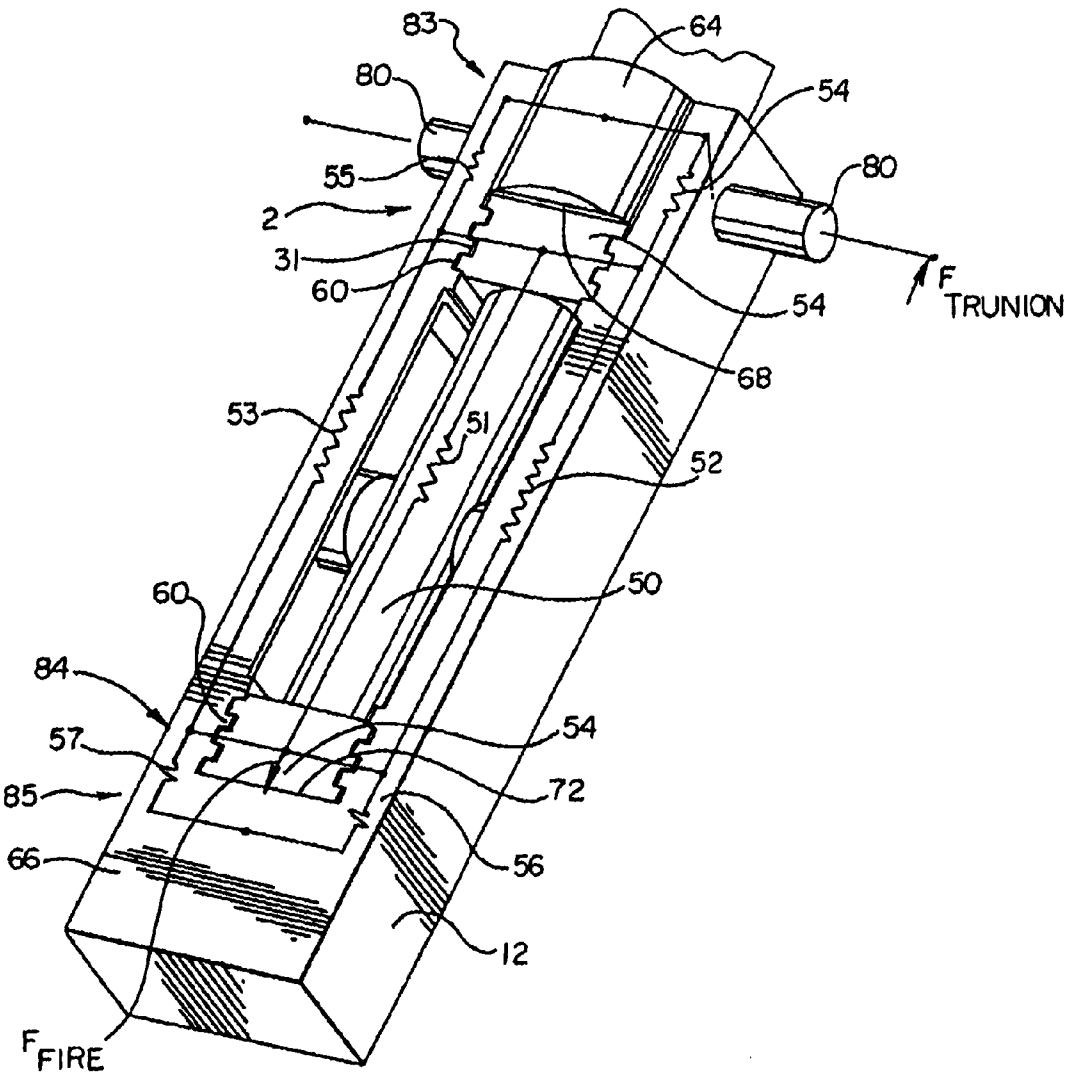
FIG. 8 is a perspective view of the breech assembly of the rotatable breech gun in a firing disposition.

In the prior cased-telescoped guns, the interlocking grooves are not present on the rotatable breech assembly 16 or the breech housing 18. Therefore, the spring rate of the rotatable breech assembly 16 does not enter into the free body force flow diagram. In this design, the firing force goes into the rear portion of the breech housing 18. Thereafter, the force goes into two parallel paths S2 and S3, as illustrated in FIG. 8, where S2 and S3 are the spring rates of each side member 24.

The spring rate for a solid material cross section is given by k=AE/L where A is the cross sectional area, E is the modulus of elasticity of the material, and L is the length of the spring. In conventional cased-telescoped guns, spring S2 and S3 will typically be the weakest since these elements need to be as long as the ammunition.

In large size guns such as 120 millimeter guns, the ammunition typically have a length of 3 feet. With this length and considering the load on the order of 1.75 million pounds, the gaps at either end of the rotatable chamber can grow to larger than ⅛ of an inch. Gaps in this range are too large for any ammunition-attached seal to effectively seal the components in the rotatable breech gun.

To make this spring stiff (increase k), and thus avoid large gaps at the ends of the rotatable breech assembly 16, the cross sectional area of the side members 24 must be increased. Increasing the cross sectional area of the side members 24 increases the weight of the gun, which negatively impacts the ability to transport the gun.

Other options include fabricating the side members 24 from materials that exhibit higher weight-to-strength ratios, such as titanium. One problem with titanium is that its modulus of elasticity is half of steel thereby making the spring rate even lower.

All of these issues are significantly reduced in smaller guns (50 millimeters and smaller). Since the bores are smaller, the ammunition lengths are shorter and the gun pressures are much less. These features are why cased-telescoped guns have enjoyed success in smaller guns.

The interlocking grooves and lands provided in the rotatable breech gun 10 of the present invention address the forces found during firing present in large guns and thereby allows the components to form a more sturdy seal. The load due to firing force F acts on the head portion 20 of the breech housing 18, as illustrated in FIG. 5. This force acts only against springs S4+S5 and S6+S7 with respect to trying to separate the rotatable breech assembly 16 from the breech housing 18.

S4 and S5 are the spring rates of each side of the breech housing 18 between an upper interlocking region 82 and a head end region 83. S6 and S7 are the spring rates of each side of the breech housing 18 between a lower interlocking region 84 and a rear end region 85. S1 is the spring rate of the breech assembly 16. S2 and S3 are the spring rates of each of the side members 24 between the upper interlocking region 82 and the lower interlocking region 84.

The distance between the interlocking regions and the end regions represents a short distance (usually less than 6 inches) with typically a solid cross section. Such a design represents a very stiff spring even if titanium is used. Since deflection is equal to the applied force divided by the spring rate, a very high spring rate is desired to keep the resulting pressure gap to a minimum.

In this embodiment of the present invention, the firing loads after going through springs S6 and S7 are then transferred to springs S1, S2, and S3. Springs S1, S2, and S3 are in parallel and thus their combined spring rate is stiffer than the stiffest of the individual springs. Since the rotatable breech assembly 16 needs to be the same outside diameter as a comparable chamber in a conventional gun due to internal pressure, the spring S1 will be the same as a typical breech gun. This spring rate will be relatively large but really has no effect on gas sealing of the breech assembly 16 since this spring rate is taken care of by springs S4, S5, S6, and S7.

The net result of this design is that springs S2 and S3 basically do not affect the gas sealing ability of the gun and thus can be made from a very lightweight material. Such a configuration complements the desire for lightweight gun mounts. Once the firing loads go through spring S1, the load passes through the interlocking groove 31 and lands 61 on the head end of the breech housing 18 and then is distributed between springs S4 and S5 before reaching the reaction point F.

The configuration of the rotatable breech gun 10 of the present invention thereby eliminates or substantially reduces gaps between the rotatable breech assembly 16 and the breech housing 18 in large caliber cased-telescoped guns during firing. Such leaks have previously presented a major stumbling block for prior art large caliber cased-telescoped gun designers.

Figure 9:
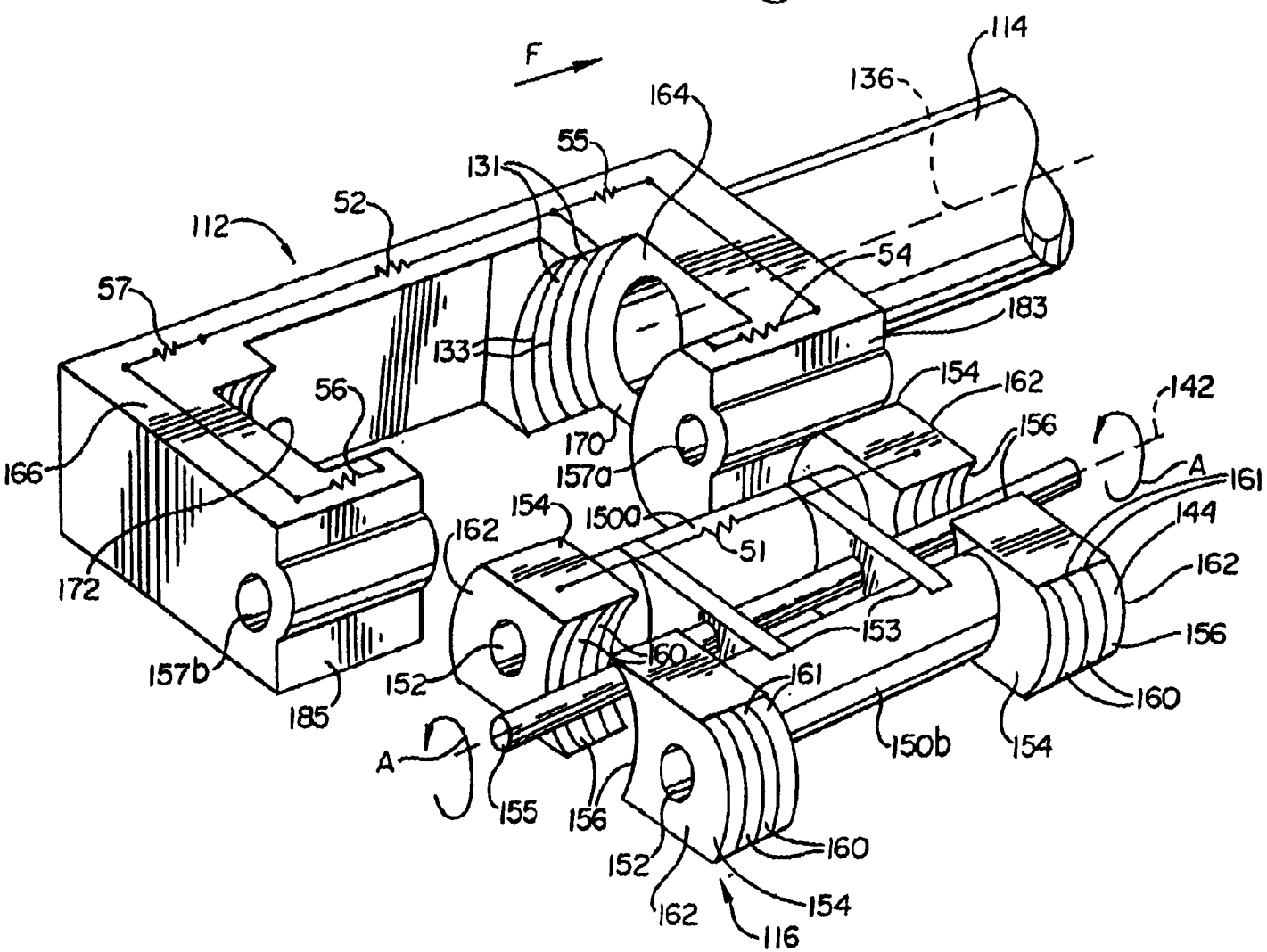
FIG. 9 is an exploded view of an alternative embodiment of the rotatable breech gun.
Figure 10:
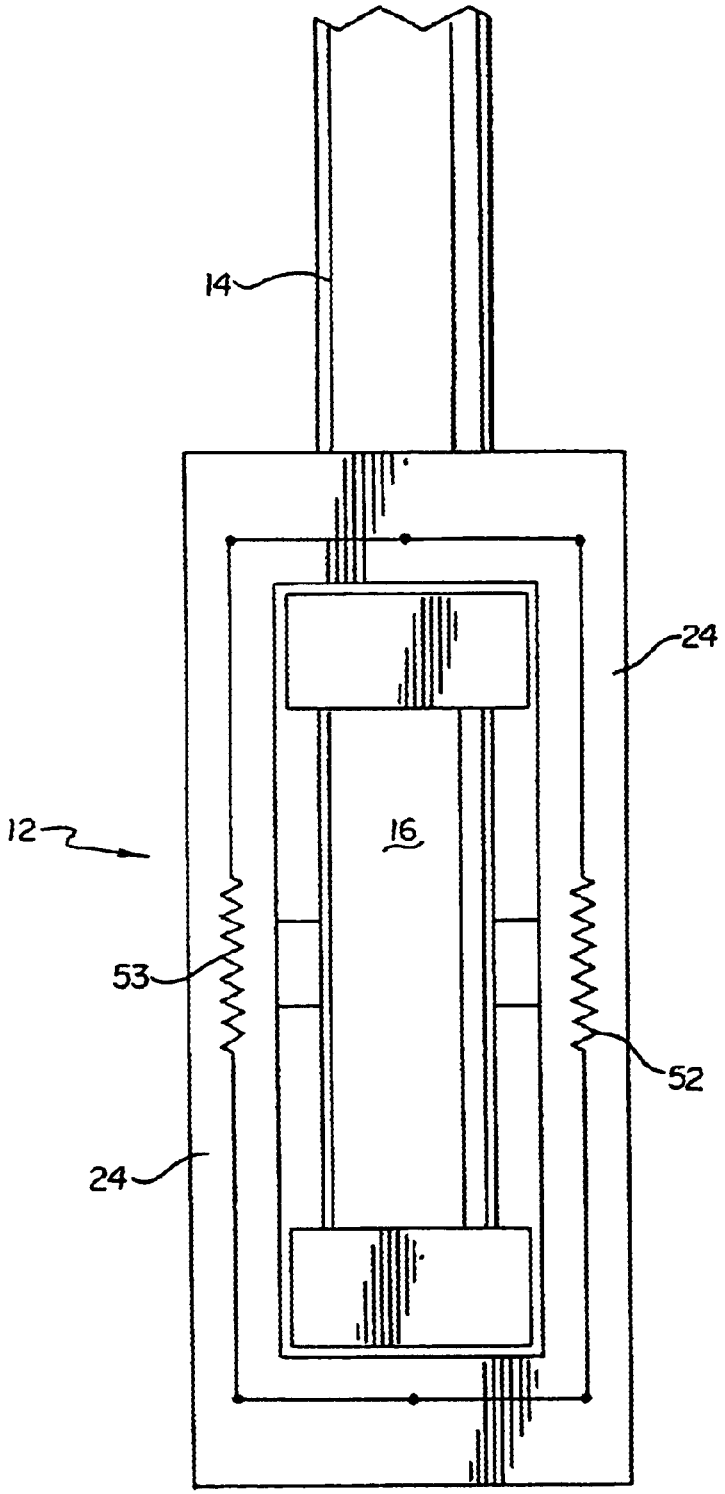
Fig. 10 PRIOR ART
FIG. 10 is a free body diagram illustrating firing forces imparted in a prior art rotatable breech gun.

An alternative embodiment of the rotatable breech gun 110 of the present invention is depicted in FIG. 9. This rotatable breech gun 110 includes a breech 116 that is rotatable with respect to an axis 142 that is parallel to and offset from a central axis 136 of the gun barrel 114. Rotating the breech assembly 116 with respect to the breech housing 118 facilitates placing ammunition into the gun 110. The rotatable breech assembly 116 is preferably fabricated in a symmetrical configuration such that a first end 144 of the rotatable breech 116 is shaped substantially the same as a second end 146 of the rotatable breech assembly 116.

The rotatable breech assembly 116 includes a pair of substantially cylindrical central portions 150*a*, 150*b* that each have a bore 152 extending therethrough. The cylindrical central portions 150*a*, 150*b* are interconnected with at least one interconnecting member 153.

Proximate a central region of the interconnecting member 153, a shaft 155 is extended therethrough. The shaft 155 is rotatably disposable in bores 157*a*, 157*b* defined in the head end 183 and the rear end 185, respectively. The bores 157*a*, 157*b* are preferably aligned in a coaxial relationship. Rotating the shaft 155 in the bores 157*a*, 157*b* with respect to the breech housing 118, as indicated by arrows A, rotates the breech assembly 116 with respect to the breech housing 118.

Proximate each end of the shaft the rotatable breech gun 110 preferably includes a mechanism that retains the shaft 155 in a fixed lateral relationship with respect to the breech housing 118. Such a mechanism absorbs forces that are imparted on the components of the breech housing 118 during the firing process and thereby simulates opposite side member 124. One potential mechanism is a channel (not shown) formed into the shaft 155 and a washer (not shown) or other retaining device that seats in the channel.

Proximate the first end 144 and the second end 146, the rotatable breech assembly 116 includes first and second end portions 154. Inner and outer side surfaces 156 of the end portions 154 preferably have at least one groove 160 formed therein. Intermediate each groove 160 is a land 161.

The inner and outer side surfaces 156 are preferably curved to correspond with a radius of the rotatable breech assembly 116. Preferably, there are at least two grooves 160 formed on each of the inner and outer side surfaces 156.

End surfaces 162 of the end portions 154 are substantially flat to facilitate forming a seal with the other portions of the rotatable breech gun 110 to prevent or substantially reduce gases from passing between the components as is described below.

The rotatable breech gun 110 includes a front block 164 and a rear block 166 that are positioned adjacent opposite ends of the rotatable breech assembly 116. The front block 164 and the rear block 166 are preferably integrally fabricated into the breech housing 118 for this embodiment.

The front block 164 has a bore 168 formed therein. The bore 168 is substantially the same size as and aligned with the bore 152 in the rotatable breech assembly 116. Similarly, the bore 168 is substantially the same size as and aligned with the bore 134 that extends through the gun barrel 114. An inner surface 170 of the front block 164 preferably has a substantially flat shape that substantially conforms to the end surfaces 162 of the end portions 154 to facilitate forming a seal between the front block 64 and the end portion 54 that prevents or substantially minimizes the amount of gas that passes between these components.

The rear block 166 has an inner surface 172 with a substantially flat shape that substantially conforms to the flat surface of the end surfaces 162 of the end portions 154 to facilitate forming a seal between the rear block 166 and the end portion 154 that prevents or substantially eliminates the amount of gas that passes between these components.

In operation, ammunition is loaded into the bore. 152 on one or both of the central portions 150*a*, 150*b* and the rotatable breech assembly 116 is rotated so that the loaded central portion 150*a* is positioned in the breech housing 118. Bore 152 is axially aligned along the central axis 136 of the barrel 114. The gun 110 is then fired. Ammunition may then be loaded into the central portion 150*b* that is not positioned in the breech housing 118 during the recoil. This motion also pushes the spent ammunition out of the central portion 150*b*. Such a process not only enhances the ability to remove spent ammunition from the breech assembly 116 but also reduces the time needed to reload the gun. While not illustrated, the rotatable breech gun 110 of this embodiment may be used with a recoil/counter recoil control system similar to the embodiment illustrated in FIGS. 1–8.

The rotatable breech assembly 116 is then rotated to move the central portion 150 with the new ammunition into the breech housing 118 and the central portion 150 with the spent ammunition to a reloading position outside of the breech housing 118. The firing rate of this embodiment of the rotatable breech gun 110 is determined by the recoil/counter recoil time only.

In this embodiment of the present invention, the firing loads after going through springs S6 and S7 are transferred to springs S1 and S2. S6 and S7 are the spring rates of each side of the breech housing 118 between a lower interlocking region 184 and a rear end region 185. S1 is the spring rate of the breech assembly 116. S2 is the spring rate of each of the side member 124 between the upper interlocking region 182 and the lower interlocking region 184. S4 and S5 are the spring rates of each side of the breech housing 118 between an upper interlocking region 182 and a head end region 183.

Springs S1 and S2 are in parallel and thus their combined spring rate is stiffer than the stiffest of the individual springs. Since the rotatable breech assembly 116 needs to be the same outside diameter as a comparable chamber in a conventional gun due to internal pressure, the spring S1 will be the same as a typical breech gun.

Once the firing loads go through spring S1, it passes through the interlocking grooves on the head end of the breech housing 118 and then is distributed between springs S4 and S5 before reaching the reaction point F.

Similar to the rotatable breech gun 10 embodiment illustrated in FIGS. 1–5, the configuration of the rotatable breech gun 110 of this embodiment eliminates or substantially reduces gaps between the rotatable breech assembly 116 and the breech housing 118 in large caliber cased-telescoped guns during firing.

It is contemplated that features disclosed in this application, as well as those described in the above applications incorporated by reference, can be mixed and matched to suit particular circumstances. Various other modifications and changes will be apparent to those of ordinary skill.

What is claimed is:

1. The rotatable breech gun comprising:

a breech assembly having a breech bore formed therein that receives ammunition loaded through an end thereof, wherein the breech assembly has a first end and a second end, and wherein a rotational axis is located intermediate the first end and the second end, a breech housing having at least one side member oriented parallel to the breech bore, wherein the breech assembly is rotatable mounted in the breech housing; and a gun barrel having a gun bore extending therethrough, wherein the gun barrel is operably connected to the breech housing such that the gun bore is aligned with the breech bore when the breech assembly is rotated in position within the breech housing, the gun barrel is aligned along a gun barrel axis and the breech assembly is rotatable about the rotational axis that is substantially perpendicular to the gun barrel axis;

wherein the breech assembly and the breech housing further include corresponding mating structures proximate at least one end of the breech bore such that forces generated by ignition of ammunition in the breech bore are transmitted to both the breech assembly the at least one side member of the breech housing, and wherein both the mating structures and the at least one side member operate to maintain a longitudinal position of the breech assembly relative to the breech housing; and wherein the that mating structures comprise at least one groove formed in the breech assembly proximate the first end and the second end and at least one land formed in the breech housing, wherein the at least one groove is adapted to at least partially receive the at least one land, and wherein the at least one groove and the at least one land are both curved to correspond to with a constant radius from the rotational axis.

2. The rotatable breech gun of claim 1, wherein the at least one groove and the at least one land are oriented substantially perpendicular to a central axis of the gun barrel.

3. The rotatable breech gun of claim 1, wherein the breech assembly has a first end surface proximate the first end and a second end surface proximate the second end, wherein the first end surface and the second end surface are both curved to correspond to with a constant radius from the rotational axis.

4. A rotatable breech gun comprising:

a front block having a bore formed therein;

a rear block;

a first side member having a first end and a second end, wherein the first end is operably connected to the front block and the second end is operably connected to the rear block, wherein the front block and the rear block each have at least one land formed therein proximate the connection with the first side member;

a second side member having a first end and a second end, wherein the first end is operably connected to the front block and the second end is operably connected to the rear block, wherein the front block and the rear block each have at least one land formed therein proximate the connection with the second side member; and a breech assembly having a first end and a second end, wherein the breech assembly has a bore formed therein that extends from the first end to the second end and that is adapted to receive ammunition, wherein the breech assembly is mounted for rotation with respect to the first side member and the second side member, wherein the first side member and the second side member have a length that is approximately the same as a length of the breech assembly, wherein the breech assembly has at least one groove formed therein proximate the first end and the second end, wherein the at least one land on the front block proximate the first side member and the second side member are adapted to at least partially seat in the at least one groove proximate the first end of the breach assembly, wherein the at least one land on the rear block proximate the first side member and the second side member are adapted to at least partially seat in the at least one groove proximate the second end of the breach assembly.

5. The rotatable breech gun of claim 4, wherein the at least one land and the at least one groove operate to maintain a longitudinal position of the breech assembly relative to the front block and the rear block.

6. The rotatable breech gun of claim 4, wherein the gun barrel is aligned along a gun barrel axis and wherein the breech assembly is rotatable about a rotational axis that is substantially perpendicular to the gun barrel axis.

7. The rotatable breech gun of claim 6, wherein the rotational axis is located intermediate the first end and the second end.

8. The rotatable breech gun of claim 6, wherein the at least one groove and the at least one land are oriented substantially perpendicular to the gun barrel axis.

9. The rotatable breech gun of claim 6, wherein the at least one groove and the at least one land are both curved to correspond with a constant radius from the rotational axis.

10. A rotatable breech gun comprising:

a breech housing having a recess formed therein, wherein the recess has a first end and a second end, and wherein the recess has at least one land formed therein proximate to the first end, and wherein the breech housing has a first side member and a second side member that define the recess, and wherein the first side member and the second side member each have the at least one land formed therein proximate the first end and the second end;

a gun barrel having a bore extending therethrough, wherein the gun barrel is operably attached to the breech housing; and a breech assembly rotatable mounted to the breech housing, wherein the breech assembly has a bore formed therein that is adapted to receive ammunition, wherein the breech assembly has a first end and a second end, wherein the breech assembly has at least one groove formed therein proximate the first end, wherein the at least one land in the breech housing is adapted to at least partially seat in the at least one groove in the breech assembly, and wherein the breech assembly is rotatable about an axis that is substantially perpendicular a central axis of the gun barrel.

11. The rotatable breech gun of claim 10, wherein the breech assembly includes a central portion and an end portion attached to each end of the central portion.

12. The rotatable breech gun of claim 11, wherein the end portions each have a pair of side surfaces, and wherein each of the side surfaces have at least one groove formed therein.

13. The rotatable breech gun of claim 12, wherein the end portions each have an end surface, wherein the end surfaces are curved to correspond with a radius from a pivot axis of the breech assembly.

14. The rotatable breech gun of claim 10, wherein at least one land in the breech housing and the at least one grove in the breech assembly are oriented substantially perpendicular to a central axis of the gun barrel.

15. The rotatable breech gun of claim 10, wherein the gun barrel is operably attached to the breech housing with at least one recoil/counter recoil cylinder.

16. The rotatable breech gun of claim 10, further comprising at least one trunnion attached to the breech housing.

* * * * *

UNITED STATES PATENT AND TRADEMARK OFFICE

CERTIFICATE OF CORRECTION

PATENT NO. : 6,637,310 B2
DATED : October 28, 2003
INVENTOR(S) : Borgwarth

It is certified that error appears in the above-identified patent and that said Letters Patent is hereby corrected as shown below:

Column 1,
Lines 30 and 34, delete “breach” and insert -- breech --.

Column 4,
Line 6, delete “reducing” and insert -- reduce --.
Line 6, delete “affects” and insert -- effects --.

Column 9,
Line 20, delete “rotatable” and insert -- rotatably --.
Line 34, after “assembly” insert -- and --.
Line 39, delete “that”.
Lines 45 and 54, delete the second occurrence of “to”.

Column 10,
Lines 19 and 23, delete “breach” and insert -- breech --.
Line 54, delete “rotatable” and insert -- rotatably --.

Column 11,
Line 9, delete “grove” and insert -- groove --.

Signed and Sealed this

Sixth Day of July, 2004

JON W. DUDAS
*Acting Director of the United States Patent and Trademark Office*